US005395115A

United States Patent [19]

Ferns et al.

[11] Patent Number: 5,395,115

[45] Date of Patent: Mar. 7, 1995

[54] GOLFING FACILITY

[76] Inventors: Derek Ferns, Glenfield, Watery Lane, Monmouth, Gwent, United Kingdom, NP5 3AT; John Garner, 2 Bank Farm Mews, Bickley, Malpas, United Kingdom, SY14 8EQ

[21] Appl. No.: 84,265

[22] PCT Filed: Jan. 17, 1992

[86] PCT No.: PCT/GB92/00112

§ 371 Date: Jul. 8, 1993

§ 102(e) Date: Jul. 8, 1993

[87] PCT Pub. No.: WO92/12767

PCT Pub. Date: Aug. 6, 1992

[30] Foreign Application Priority Data

Jan. 18, 1991 [GB] United Kingdom ..... 9101125
May 4, 1991 [GB] United Kingdom ..... 9109742

[51] Int. Cl.[6] ..... A63B 69/36
[52] U.S. Cl. ..... 273/176 G; 273/35 B
[58] Field of Search ..... 273/176, 35 B, 32 R, 273/180, 181 R, 181 F, 35 R, 195 R, 175 B

[56] References Cited

U.S. PATENT DOCUMENTS

| | | | |
|---|---|---|---|
| 3,314,679 | 4/1967 | Kolln . | |
| 3,408,750 | 11/1968 | McCollough et al. . | |
| 3,708,173 | 1/1973 | Hewron, Jr. | 273/176 A |
| 3,990,708 | 11/1976 | Ingwersen | 273/181 F |
| 3,999,764 | 12/1976 | Nitsche | 273/176 G |
| 4,283,056 | 8/1981 | Miller . | |
| 5,031,916 | 7/1991 | Borwell | 273/176 H |
| 5,092,600 | 3/1992 | Ruth, Jr. et al. | 273/35 B |
| 5,163,677 | 11/1992 | Foley | 273/181 R |

FOREIGN PATENT DOCUMENTS

| | | |
|---|---|---|
| 0308833 | 3/1989 | European Pat. Off. . |
| 8700045 | 4/1987 | Germany . |
| 664701 | 3/1988 | Switzerland . |
| 2206496 | 1/1989 | United Kingdom . |

*Primary Examiner*—Mark S. Graham
*Attorney, Agent, or Firm*—Young & Thompson

[57] ABSTRACT

A golfing facility comprises a rotatable central tee-off area and a plurality of sectors disposed around the tee-off area. Each sector contains a selection of targets to enable a player to simulate playing a hole of golf (with the exception of the final put). Various training aids and scoring apparatus are also described.

12 Claims, 6 Drawing Sheets

GOLFING FACILITY

FIELD OF THE INVENTION

This invention relates to a golfing facility.

BACKGROUND OF THE INVENTION

It is well known in this country and overseas that the rising popularity of golf is not being adequately matched by the number of new courses built. This is mainly because of the large area of land required, with the consequent cost of land purchase, planning and construction. It will be understood also that any golf course has a finite limit on the number of golfers on the course at any one time to avoid congestion. There are golf driving ranges which allow a number of golfers to practice in a small area but it is usually not possible for a player to "mark" his shot amongst those of the other golfers and so most practice ranges are not particularly inspiring for golfers who want a substitute for a real game.

A need exists therefore for a golf playing area which allows a large number of golfers to play in a relatively small, compact area to help satisfy the rising demand for golfing facilities. A need also exists for a compact golf playing area which allows golfers to play a simulated round of golf consisting of a number of holes of different length and difficulty and ideally which allows the players to score. Furthermore, there is a need for an interactive professional training system for golfers.

SUMMARY OF THE INVENTION

Accordingly, in one aspect, the invention provides a golfing facility comprising a plurality of holes or targets disposed around a starting or tee area in which is defined a plurality of bays or sites from which in use golfers may play shots toward selected holes or target.

Preferably the starting or tee area constitutes an "island" in a playing area which contains the targets or holes. Depending on the plot of land available etc. the starting or tee area may be located suitably (centrally or otherwise) within the playing area, with the targets or holes disposed suitably (radially or otherwise) with respect to the starting or tee area. The starting or tee area may be single- or multi-tiered.

To increase the number of targets available to users during a playing session, the starting or tee area may be indexable or rotatable to present players with a different selection of holes or targets. The starting or tee area may be located within a building or other structure. For example a rotunda or similar structure may define a series of playing sectors or bays. In this case the whole or part of the rotunda may be rotatable with suitable drive means being provided for indexing or rotating the rotunda or part thereof at required intervals.

The starting or tee area may offer other provisions. For example, there may be covered or uncovered practice or putting greens, restaurants, bars, shops, viewing galleries to allow spectators to look out over the playing area etc. There may be a tunnel or other means for conveying golfers or other users from a car park disposed at or near the outer edge of the playing area to the starting or tee area. The tunnel may be underground or may include a transparent wall or walls.

The starting or tee area preferably includes means for analyzing a golfer's performance and for presenting a selected pre-recorded audio-visual tutorial from a library thereof, e.g. by means of a T.V. screen and loudspeaker. The analysis may be on the basis of either or both of the shot itself, for example the length and/or trajectory, and the golfer's action, for example his stance, grip, swing and/or balance.

The holes or targets are preferably arranged so that each playing bay or site has associated therewith a selection of various grades of difficulty. The playing area may be subdivided by markers such as fencing or trees into separate playing sectors for each starting or tee area but this need not be so. Also, the playing bays themselves may be graded according to skill so, for example there may be one or more novice's bays where the holes or targets are closer or easier to reach than elsewhere.

The holes or targets may be coded by colour or otherwise to indicate their degree of difficulty so that players may choose how stiff the challenge should be. The colour coding may also form the basis of a scoring method with each target or hole having a score allocated to it. The holes or targets may have means for measuring the "miss distance" to allow a further level of scoring.

The playing area preferably includes areas of water disposed near the targets or holes and the water areas may conveniently have ball collection means associated therewith. The ball collection means may include pump means or other circulation means for causing balls which land in the water to tend to collect at an area ready for being conveyed back to the starting or tee area. The floor of the water area may slope towards a collection area or channel. We have found that there is a critical minimum depth to ensure that a ball landing in the water creates a splash to help a player "mark" his shot. Accordingly the depth is preferably more than 4" and ideally about 6".

Although ball collection machines exist for collecting balls from the fairway, we have found that such machines are not particularly effective during winter and so we propose that a substantial amount of the playing area other than the "greens" or regions immediately surrounding the targets be given over to water. Thus, typically more than half the non-green area is water. Because novices' shots are usually more erratic than those of experienced players the proportion of water area in any sectors exclusively for novices may be greater. We have also found that the water is barely visible to a player if more than 100 yards away.

It is preferred for the holes or targets to be surrounded by a green or similar area. To help a player mark his ball on the green, the greens are preferably inclined towards the starting or tee off area rotunda, with the angle of inclination increasing with distance away from the starting or tee area. The greens may include a single hole or target or a plurality thereof. To assist ball collection, the ground surface around the greens preferably falls near vertically and sharply away such that at least a major part of the periphery of the green is raised above the surrounding area so that balls rolling off, or falling just off the green tend to roll well away for easy collection. In a preferred embodiment each green has an outer wall inclined at 30° or greater to the horizontal.

At least some of the holes are preferably configured to have similar features to holes on internationally well-known courses. Thus, for example, each playing bay may include amongst its selection of holes a replica of a famous hole. The playing area may also include bunkers or sand traps disposed off and around the greens. Both the bunkers and the water areas may be made to appear larger than they are by placing behind them a reflective mirror or screen, e.g. of polished or lacquered metal.

According to another aspect of this invention, there is provided a golfing facility comprising a suitably situated or central starting or tee area and a plurality of holes or targets disposed around the starting or tee area, the starting or tee area being movable relative to said holes or targets to present players with a different selection of holes or targets.

According to another aspect of this invention, there is provided golf ball collection apparatus associated with a water area of a golf course or golfing facility, said golf ball collection apparatus including means for causing golf balls landing in said water area to collect at a collection region whence they may be retrieved. These means may be a sloping or contoured floor or a means for creating a circulation or current in the water. The circulation or current means may comprise a pump and this or another pump may be used to convey balls to a delivery region remote from the water area.

According to another aspect of this invention, there is provided a golfing facility comprising a suitably situated or central starting or tee area, a plurality of greens disposed within reach of a single stroke from the starting or tee area, the greens being inclined towards the starting or tee area.

Preferably, greens further away from the starting or tee area are inclined at greater angles.

According to another aspect of this invention there is provided apparatus for tutoring or teaching a game of the type wherein a player plays or takes a shot, said apparatus including means for observing and/or analyzing at least one characteristic of the shot (for example the trajectory of the shot or the player's movements) and means responsive to said observing and/or analyzing means for selecting and displaying a prestored audio-visual tutorial.

According to another aspect of this invention, there is provided a golfing facility including a starting or tee area and a driving range or larger area, the starting or tee area defining a plurality of playing bays, at least some of the bays having associated therewith audio visual presentation means having a plurality of prestored tutorials on various topics.

The audio visual presentation means may be actuated automatically on entry of a player into a bay.

Although golf driving ranges are already known, they fail to provide the challenge and opportunity for strategy supplied by a proper golf course. In such ranges, the player simply plays shot after shot and, whilst he may see whether the ball has been played straight, he cannot usually detect the length of the shot. In a real game, of course, the player's control and assessment of the length of his shot, and his ability to assess the length to go to the green are critical. A need therefore exists for an improved driving range which allows a player to practise these aspects of his game.

Accordingly, this invention provides a driving range including a tee-off area and a playing zone extending away therefrom, a plurality of markers spaced along the playing zone for indicating the range from the tee-off area and a plurality of staggered target areas or greens disposed within the playing zone.

Preferably, the greens "overlap" in distance from the tee area.

In this way, a hole of a particular length can be simulated by setting the player a target distance which he achieves by playing a series of one or more shots from the tee-off area, ending with a shot to the green, the total length of the shot or shots being approximately equal to the length of the simulated hole. Once the player has reached the green he may play his approach shots on a practice green which can be located within a central rotunda of the type disclosed above.

Preferably, each target area or green is of generally the same shape but increases with size according to its distance from the tee-off area. Alternatively, the greens may have different shapes.

Preferably, the markers are coded, for example by colour, to allow identification of the range by means of a chart displayed at the tee-off area.

Preferably, the target areas or greens are disposed in the playing zone to provide a substantially uninterrupted fairway. In one arrangement the target areas or greens are aligned in radial sets of one or more, leaving an uninterrupted corridor serving as the fairway.

Whilst the invention has been described above it includes any inventive combination of the features set out above or in the following description.

BRIEF DESCRIPTION OF THE DRAWINGS

The invention may be performed in various ways and three embodiments and modifications thereof will now be described in detail, reference being made to the accompanying drawings, in which.

DETAILED DESCRIPTION OF THE INVENTION

Figure 1:
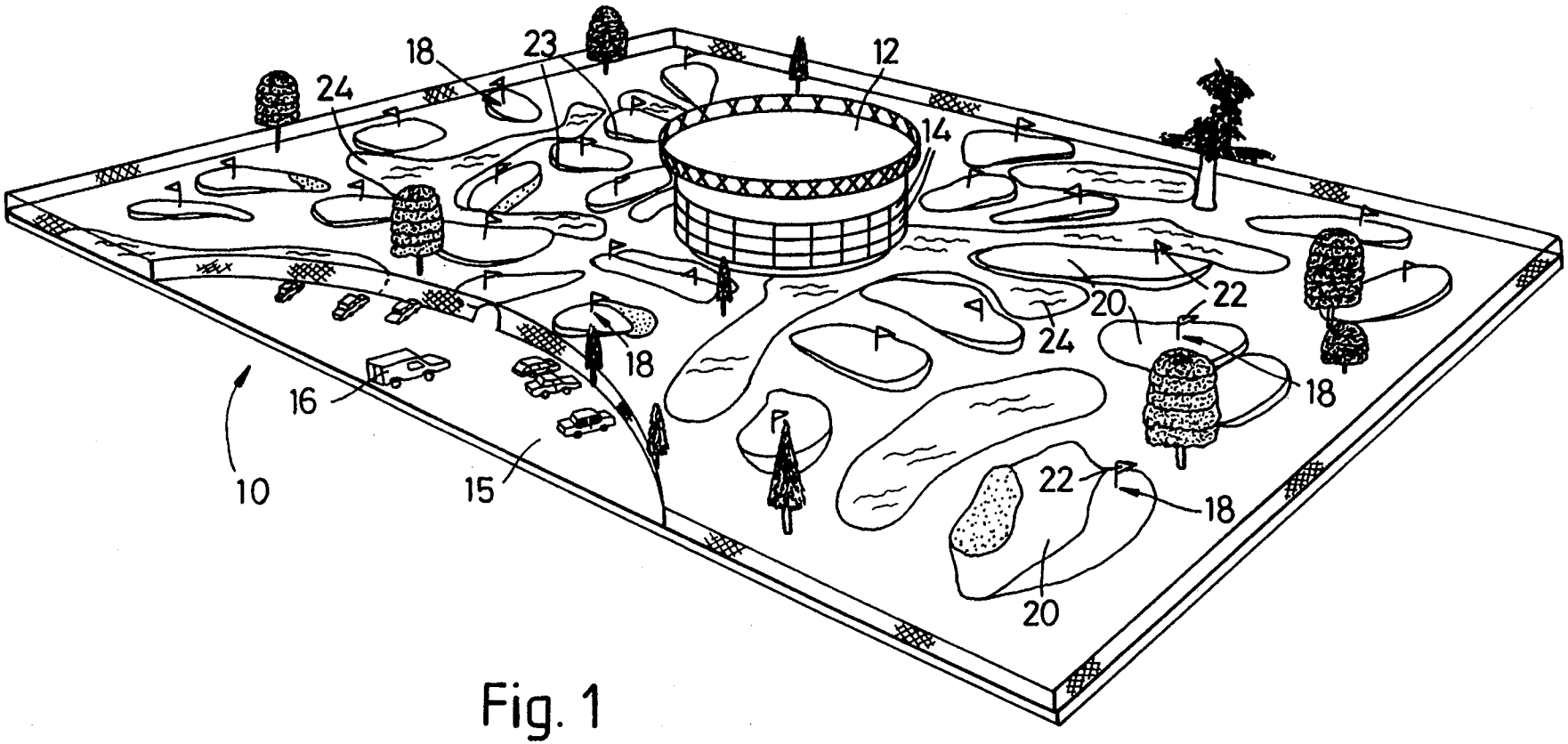
FIG. 1 is a perspective view of a golfing facility in accordance with the invention.
Figure 2:
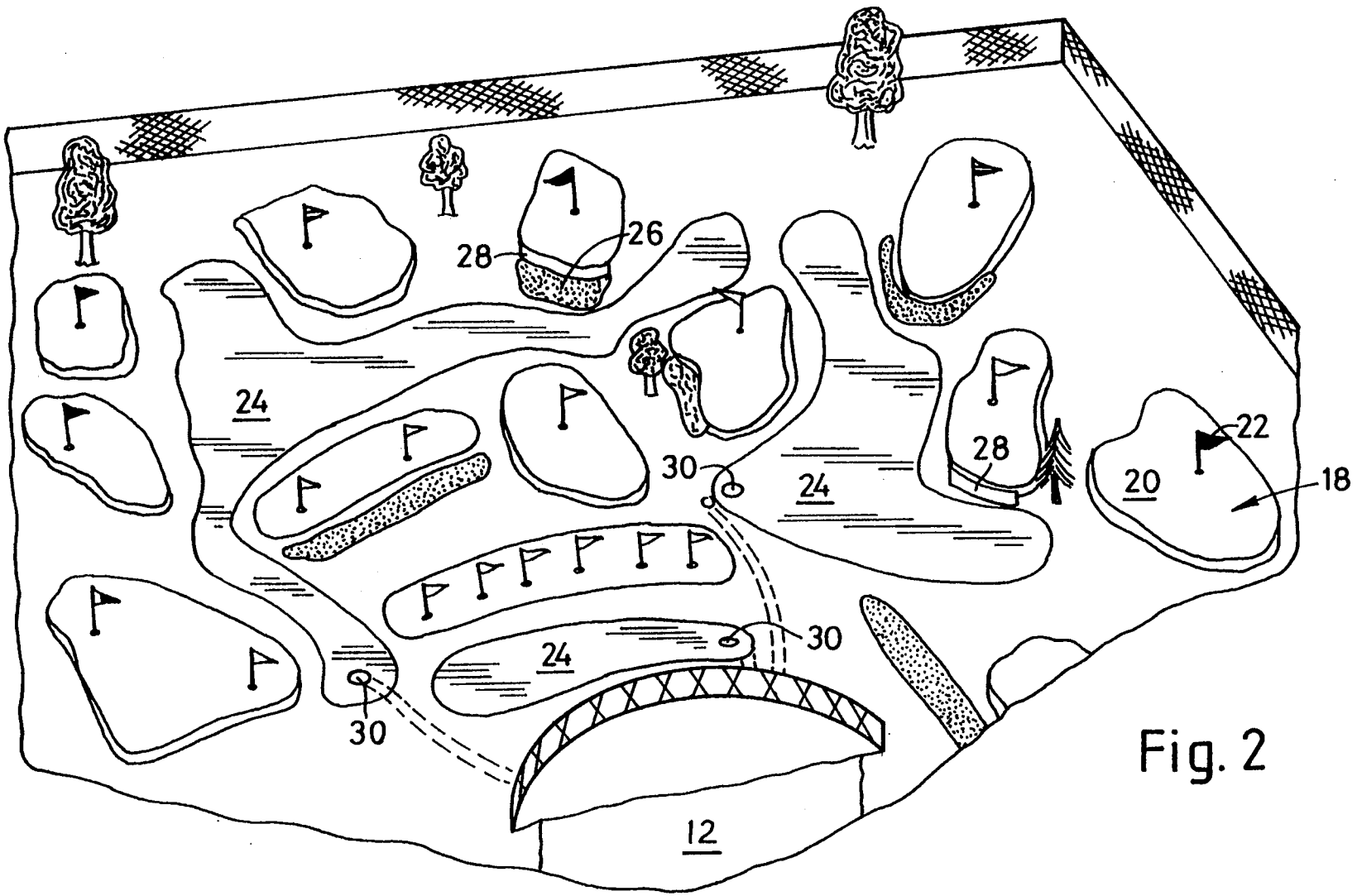
FIG. 2 is a view on an enlarged scale of part of the golfing facility of FIG. 1.

The golfing facility 10 of FIGS. 1 to 5 is set out in a rectangular plot measuring about 200 meters by 600 meters although clearly this facility may be fitted into areas of different shape and size as available. The facility comprises a centrally located rotunda 12 which provides a starting or tee area which defines a number of playing bays or sectors 14 to be described in greater detail in connection with FIG. 4. The rotunda is connected by a transit overground or underground tunnel (not shown) to a car park 15 provided at the edge of the plot so that players may park their cars and then be transported to the tee off area or rotunda 12 by a delivery vehicle 16.

The plot includes a number of holes or targets 18 located on greens 20 and shown marked by flags 22. The flags are colour coded to indicate the degree of difficulty of the particular hole 18 and possibly also to allow a system of scoring. The greens 20 are inclined towards the rotunda 12 so that players at the rotunda can see where on the green the flag is and also mark their ball on the green. For this reason, the greens further away from the rotunda are inclined more steeply. The ground around the greens falls sharply away to define sheer walls 23 to assist ball collection.

Between and around the greens 20 are provided water areas 24 and bunkers or sand traps 26. As shown at 28, some of the water areas and sand traps 26 are made to look larger by upstanding reflecting walls of polished metal provided behind the area.

The water areas 24 include a ball collection system in which balls which fall into them are collected. The floors of each water area slope towards a ball collection point 30 or slot whence they are conveyed by suitable means (for example a pump) back to the rotunda 12. A circulation or current may be created in the water which causes the balls to drift toward the collection point.

Figure 3:
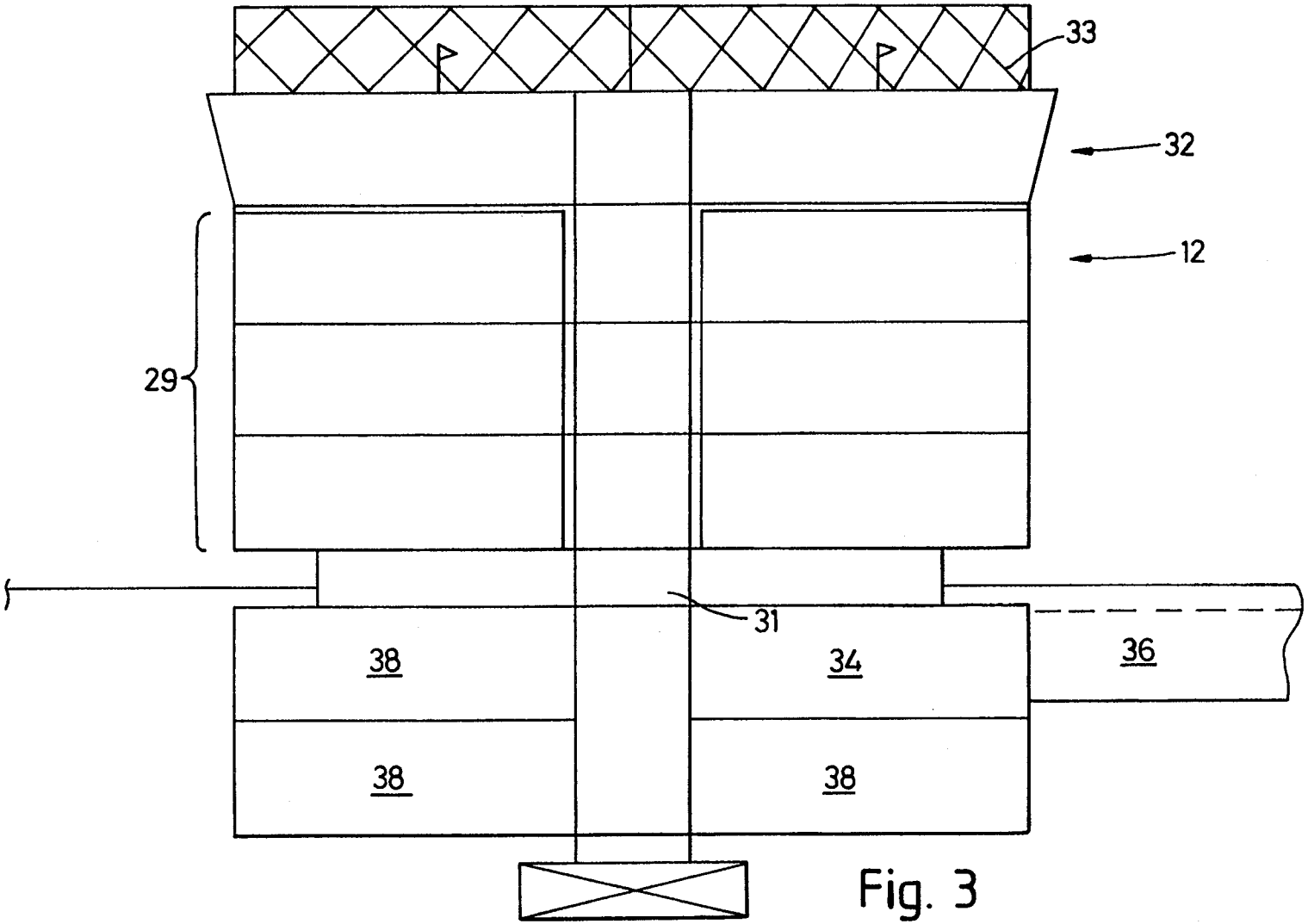
FIG. 3 is a schematic section view through the central rotunda of the golfing facility of FIG. 1.
Figure 4:
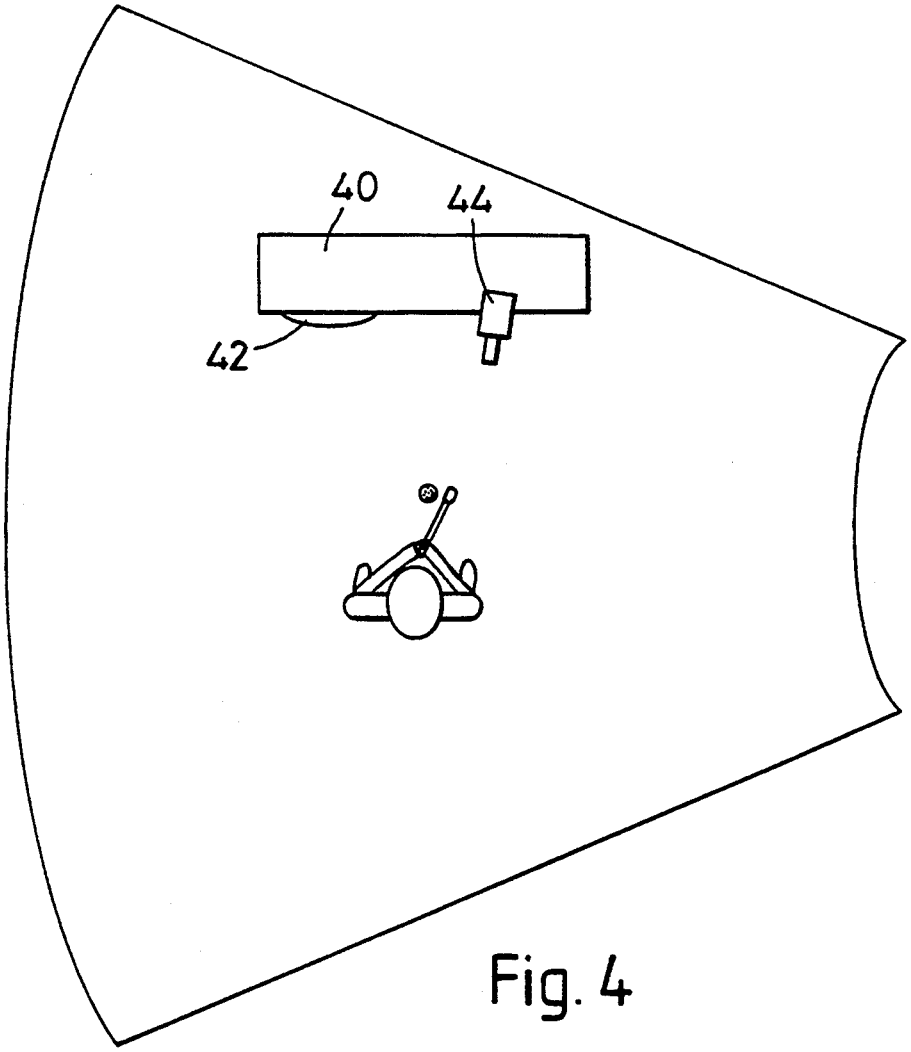
FIG. 4 is a top plan view of one of the playing bays in the rotunda of FIG. 3.

Referring to FIGS. 3 and 4, the rotunda 12 is a multistorey structure including a starting or tee area, here in the form of a rotatable ring sub-structure 29 defining three tiers of separate playing bays 14. The sub-structure is rotatably carried by a central support/access pillar 31 and may be indexed through 360° by a suitable drive (not shown). On top of the rotatable sub-structure 28, there is a stationary viewing gallery 32 containing bars and restaurants, and on top of that an outdoor putting practice green 33. Beneath the rotatable ring sub-structure there is a ground level family entertainment and retail shopping area. Below ground level there is a reception 34 where players are delivered from the underground tunnel 36, a central access shaft and a number of separate indoor activities such as putting areas 38.

Referring now specifically to FIG. 4 each playing bay or sector 14 looks out over a corresponding sector of the playing area. The sectors may be delineated by features such as fences or trees but this need not be so. In each sector of the playing area there is a selection of possible holes to give the players a choice. At regular time intervals, say every 15 minutes, the rotatable sub-structure indexes so that the playing bays look out over the next sector of the playing area. Each playing bay contains a key to the grades of difficulty of each hole as indicated by colour of the flags 22.

Some of the target holes are configured as replicas of holes of world-famous golf courses. Towards the edge of the playing area there may be buildings to provide interesting visual features and possibly accommodation for equipment.

In use the player(s) drive off towards the target greens and play the shorter approach shots. They then turn round and walk into the central area of the rotunda immediately behind the player(s) onto the putting etc area 38. This provides a complete simulated pitch, putting and bunker areas of either artificial or natural turf which covers the whole or part of the central core of the available floor area of the building structure. This might be for example 100 m or so in diameter. Thus the player may complete his scoring for a hole by transferring into the central area.

Adjacent the target areas or greens there may be marked areas which correspond to related placing or dropping zones in the central area to indicate to a player where he should drop his ball when he transfers from the external playing area to the internal playing area. Thus, together, the external and internal playing areas simulate a hole to be played and which can be scored as in conventional golf.

Each playing bay also includes means for analyzing the shot played by a player and for playing to him a pre-recorded tutorial session by a top golfing professional to help remedy any faults in his play. There is a console 40 with a video screen 42 and loudspeaker and containing a playback system (not shown) with a store of electronic or pre-recorded tutorials designed to teach a preferred grip, swing, balance stance etc. In the simplest form the player himself selects the appropriate tutorial. In an advanced system the player and the shot are observed by an electronic or television camera 44 and image processing and artificial intelligence and/or conventional techniques used to perform an electronic image or computer analysis of the shot, the analysis being used to select and automatically present to the player the appropriate tutorial or tutorials.

Figure 5:
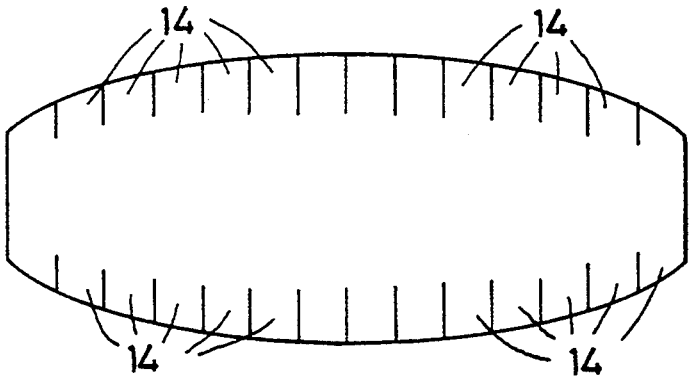
FIG. 5 is a top plan view of an alternative starting or tee off area.

Instead of being generally circular, the starting or tee-off areas may present the playing bays 14 in straight or gently curved rows as shown for example in FIG. 5.

The illustrated embodiment of golfing facility allows great flexibility; on the one hand it can provide effective on-the-course teaching for novice golfers, and on the other it can provide a simulated round of golf for the more seasoned player. Driving shots can be played from the playing bays whilst green shots can be played on the indoor or outside putting greens. Of great commercial importance is the fact that the facility allows a high number of players to play within a compact area without the congestion to which conventional courses are prone.

To improve personal shot identification in the target area, the balls issued to the players may be colour coded.

The starting mats used in the playing bays may be square, rectangular or other shapes such as circular.

Figure 6:
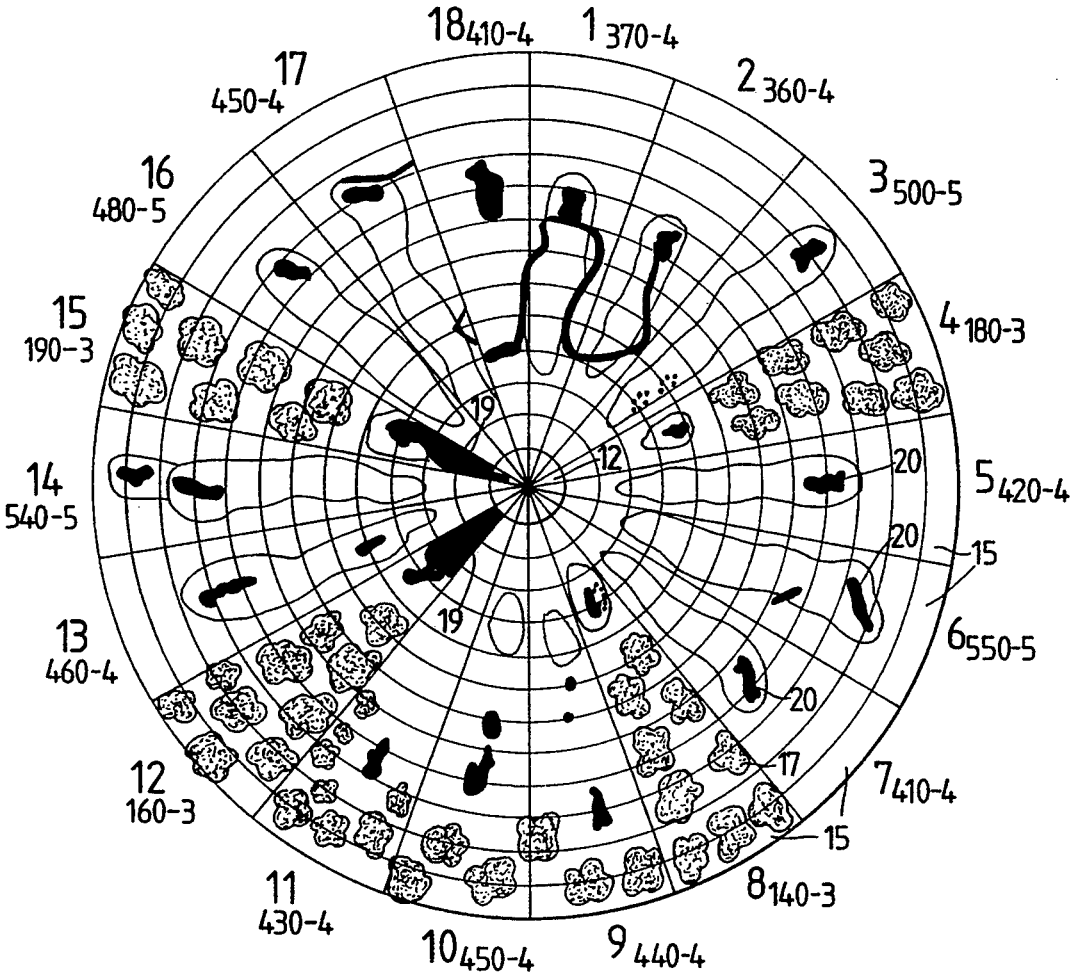
FIG. 6 is a top plan view of a second embodiment of golfing facility.

FIG. 6 illustrates a circular layout having a central rotunda 12 and eighteen sector shaped playing areas 15 each having a green 20 and other obstacles such as trees 17, water features 19, sand traps etc and having different yardages and par scores as indicated in the Figure. By creating the appropriate architectures and landscapes, the playing areas can simulate famous golf holes around the world, e.g. "The Postage Stamp" at Troon, "The Road Bridge" at St. Andrews or "The Twelfth" at Augusta, U.S.A.

In another aspect, the invention extends to a board game for simulating the game of golf. The board game comprises a board marked out with a series of holes laid out either as in a conventional 18-hole golf course or in the manner of the golfing facility of FIGS. 1 to 5. In each case the tee-to-green principle of scoring is used and obstructions on the board are marked between the tee and the green.

The board preferably carries information identifying, for each hole, the tee-to-green length and the degree of difficulty of the hole. This information may be duplicated onto cards for each of the players so that they may work out how to play the hole, the distance to go and so on. The game preferably also includes a number of "option" or "bisque" cards a player may use during the game. There may be favourable option cards which, for example, allow a player to take a hole one under par, or unfavourable cards which, for example, add shots to the player's score.

Additionally, there are a number of dice. For example, four dice may be provided: one for the drive from the tee to the fairway, one for the shot from the fairway to the green, one for the approach to the hole, and one for use when the player encounters an obstacle. Alternatively, two dice may be provided, one for the length of shot and one for the quality of the shot.

Figure 7:
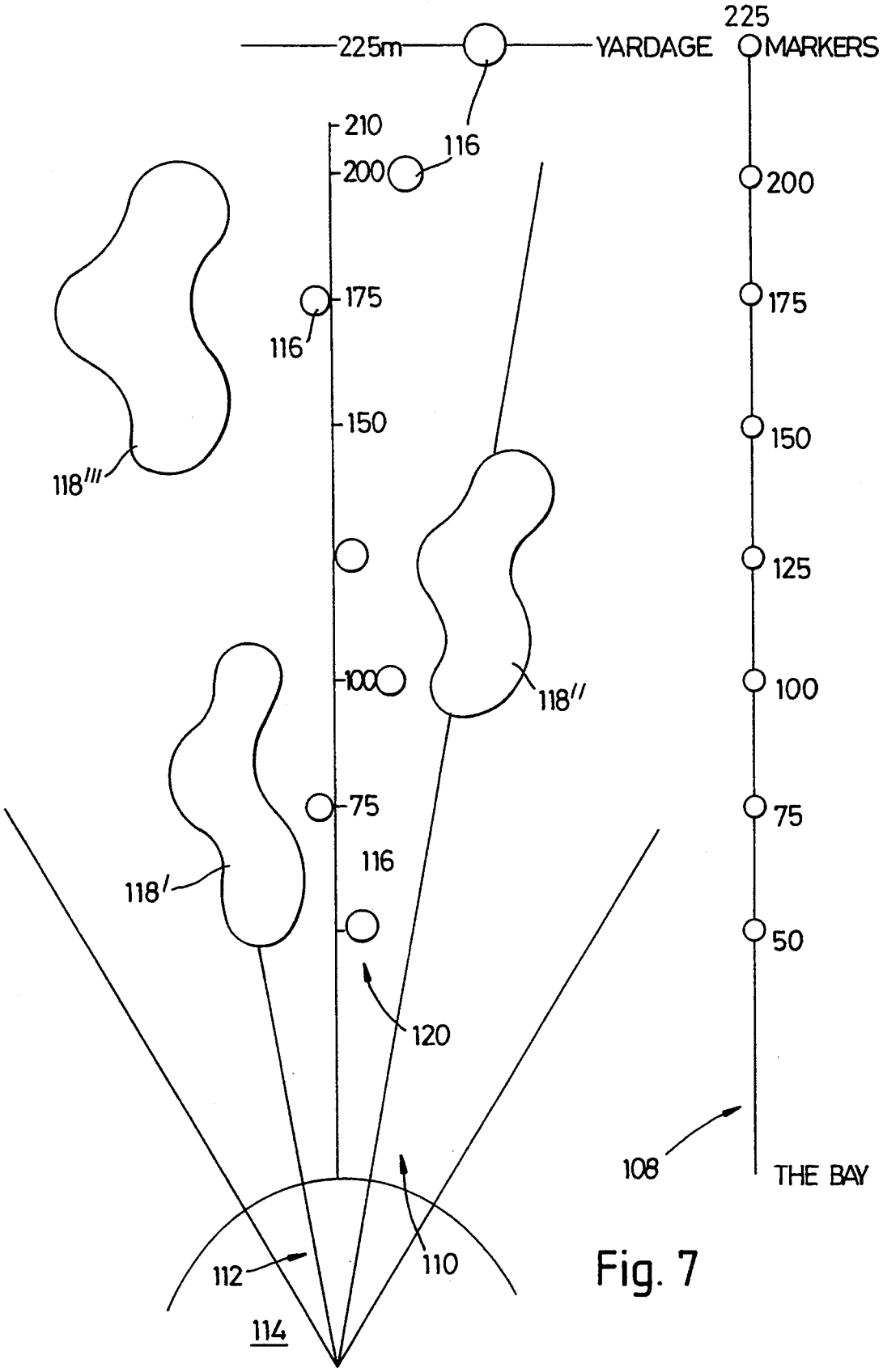
FIG. 7 is a diagrammatic representation of a practice sector or playing and yardage chart zone of a golfing facility according to a further embodiment of this invention.

Reference is now made to the embodiment of FIG. 7, which illustrates schematically a practice sector or playing zone of a golfing facility, together with a yardage chart for display in the playing bay.

The practice sector 110 extends outwardly from a playing bay 112 provided in a central rotunda 114. The rotunda 114 may be of the type described in relation to the embodiments of FIGS. 1 to 5. The rotunda 114 may either be stationary or it may be indexable or rotatable so that the playing bays 112 are presented to a succession of different practice sectors 110.

The practice sector 110 includes a series of circular markers 116 positioned at 50 yards (about 50 m) and thereafter at 25 yards (about 25 m) intervals up to 225 yards (about 225 m). As shown here the markers may take various angular positions relative to the bay 112 to allow for other features in the sector such as greens, water or bunkers. The markers are coded by colour or otherwise to allow easy identification and a yardage chart 108 is displayed within the playing bay 112 to identify the range of the markers.

The practice sector also includes three greens 118 extending generally radially to either side of a central fairway 120. The practice sector may include more than or fewer than three greens but, where applicable, they are generally provided in radially aligned sets to either side of the fairway 120. The greens 118 are staggered and "overlap" so that the furthest edge of the closest green 118' is further than the closest edge of the next green 118'' and so on.

In use each bay has a target yardage or a series of yardages which include an element of handicap. Each player must then achieve that yardage by one or more shots, ending on a green, whereupon the approach shots are played on a practice green which may be elsewhere. It is up to the player how he achieves the yardage depending on his own personal range and accuracy.

We claim:

1. A golfing facility comprising a playing area in which is located a tee area structure having disposed around the periphery thereof a plurality of driving sectors from which, in use, golfers may drive balls outwardly from the tee area structure into the surrounding playing area, the playing area comprising a plurality of target sectors extending generally radially outwards from the tee area structure and disposed side-by-side around the periphery thereof, the number of target sectors corresponding to the number of driving sectors, and each target sector including a different arrangement of targets towards which balls are to be driven, the tee area structure being rotatable relative to the playing area and having means for rotationally indexing it through a succession of rotational positions in which each driving sector faces a different target sector of the playing area.

2. A golfing facility according to claim 1, wherein the rotatable tee area structure comprises a ring sub-structure which is rotatable around a stationary central structure.

3. A golfing facility according to claim 2, wherein said stationary central structure includes a putting area.

4. A golfing facility according to claim 1, wherein the rotatable tee area structure is multi-tiered.

5. A golfing facility according to claim 1, wherein features are provided in the playing area to delineate each target sector from an adjacent target sector.

6. A golfing facility according to claim 1, wherein each target sector includes at least one green, and wherein each green is inclined towards the tee area structure.

7. A golfing facility according to claim 6, wherein the angle of inclination of the greens increases with their distance from the tee area structure.

8. A golfing facility according to claim 1, wherein a plurality of markers is spaced along each target sector as it extends away from the tee area structure, said markers indicating the range from the tee area structure.

9. A golfing facility according to claim 8, wherein each target sector further includes a plurality of staggered greens disposed within the target sector.

10. A golfing facility according to claim 9, wherein the greens in each target sector overlap in distance from the tee area structure.

11. A golfing facility according to claim 1, wherein at least some of said target sectors include areas of water, at least one of said water areas having a collection area to which balls landing in the water are conveyed.

12. A golfing facility according to claim 11, wherein the water area has a floor which slopes downward towards said collection area.

* * * * *